US011318492B2

(12) United States Patent
Aumer et al.

(10) Patent No.: US 11,318,492 B2
(45) Date of Patent: May 3, 2022

(54) HOT GLUE UNIT FOR A LABELING MACHINE WITH EXTRACTOR

(71) Applicant: Krones AG, Neutraubling (DE)

(72) Inventors: Benjamin Aumer, Rettenbach (DE); Elmar Reese, Straubing (DE); Gabriel Seibold, Obertaubling (DE); Konrad Senn, Alteglofsheim (DE); Soeren Meissner, Regensburg (DE); Christian Holzer, Schierling (DE); Bernd Schroll, Regensburg (DE)

(73) Assignee: Krones AG, Neutraubling (DE)

( * ) Notice: Subject to any disclaimer, the term of this patent is extended or adjusted under 35 U.S.C. 154(b) by 405 days.

(21) Appl. No.: 16/106,810

(22) Filed: Aug. 21, 2018

(65) Prior Publication Data

US 2019/0070628 A1 Mar. 7, 2019

(30) Foreign Application Priority Data

Sep. 7, 2017 (DE) ..... 20 2017 105 400.4

(51) Int. Cl.

| | |
|---|---|
| ***B05C 1/08*** | (2006.01) |
| ***B65C 9/22*** | (2006.01) |
| *B05C 15/00* | (2006.01) |
| *B05C 1/12* | (2006.01) |
| *B05C 11/04* | (2006.01) |
| *B65C 9/00* | (2006.01) |

(52) U.S. Cl.

CPC ..... *B05C 1/0817* (2013.01); *B65C 9/2247* (2013.01); *B65C 9/2256* (2013.01); *B05C 1/08* (2013.01); *B05C 1/12* (2013.01); *B05C 11/048* (2013.01); *B05C 15/00* (2013.01); *B65C 2009/0075* (2013.01)

(58) Field of Classification Search

CPC ..... B05C 1/0817; B05C 1/08; B05C 1/12; B65C 9/2247; B65C 9/2256; B67C 3/22; B67C 2003/227; B67C 2003/228; B65B 3/022

USPC ..... 53/558, 561, 167, 136.1

See application file for complete search history.

(56) References Cited

U.S. PATENT DOCUMENTS 3,897,296 A * 7/1975 Waldrum ..... B29C 65/245 156/304.2
5,275,678 A * 1/1994 West ..... B65C 3/16 156/215

(Continued)

FOREIGN PATENT DOCUMENTS

CN 107 116 798 A 9/2017
CN 107116798 * 9/2017 ..... B08B 15/04

(Continued)

OTHER PUBLICATIONS

Machine Translation of Wei (CN107116798) (Year: 2017).*

*Primary Examiner* — Anna K Kinsaul
*Assistant Examiner* — Himchan Song
(74) *Attorney, Agent, or Firm* — Lowenstein Sandler LLP

(57) ABSTRACT

The present disclosure relates to a hot glue unit for a labeling machine in the beverage processing industry. The hot glue unit includes a housing, a glue roller disposed in an interior of the housing, a glue container, and a filter unit including an extractor connected to the housing. The extractor is to extract gases from the interior of the housing and supply the gases to the filter unit before the gases are to exit the hot glue unit.

17 Claims, 3 Drawing Sheets

(56) References Cited

U.S. PATENT DOCUMENTS

| | | | | |
|---|---|---|---|---|
| 5,350,482 | A * | 9/1994 | Westbury | B65C 3/12 118/264 |
| 8,402,721 | B2 * | 3/2013 | Kramer | B05C 1/0817 118/261 |
| 9,470,368 | B2 * | 10/2016 | Ganzer | F17D 1/088 |
| 10,213,806 | B2 * | 2/2019 | Meyer | B05C 11/1042 |
| 2001/0030020 | A1 * | 10/2001 | Nandy | B31D 1/021 156/289 |
| 2009/0117387 | A1 * | 5/2009 | Scadden | B29C 65/0681 428/411.1 |
| 2014/0120254 | A1 * | 5/2014 | Ross | B05B 7/166 427/207.1 |
| 2014/0231026 | A1 * | 8/2014 | Peckham | B65C 9/14 156/556 |
| 2017/0275041 | A1 * | 9/2017 | Cridland | B41M 5/30 |
| 2018/0280898 | A1 * | 10/2018 | Hoffmann | B29B 7/401 |
| 2019/0127104 | A1 * | 5/2019 | Gertlowski | B05C 11/1047 |

FOREIGN PATENT DOCUMENTS

| | | | |
|---|---|---|---|
| DE | 89 02 427 | A1 | 4/1989 |
| DE | 20 2016 104 049 | U1 | 9/2016 |

* cited by examiner

HOT GLUE UNIT FOR A LABELING MACHINE WITH EXTRACTOR

RELATED APPLICATIONS

This Application claims the benefit under 35 U.S.C. § 119(a) of German Patent Application 20 2017 105 400.4, filed Sep. 7, 2017, which is incorporated by reference herein.

TECHNICAL FIELD

The present disclosure relates to a hot glue unit for a labeling machine and to a labeling machine for labeling containers.

BACKGROUND

Hot glue units in connection with labeling machines in the beverage processing industry are known from prior art.

For example, DE 20 2016 104 049 U1 shows a hot glue unit with which an extractor is associated for extracting glue vapors from a glue roller.

The previous systems for extracting vapors produced when heating glue do not operate completely reliably with regard to extraction. In the previous systems, gases can escape into the environment of the hot glue unit, which can lead to pollution of the environment (e.g., the air in the environment). For labeling machines that label containers which are still open, the escape of such gases can also lead to the contamination of the interior of the containers. Furthermore, the power required for the extractor due to the total gas volume extracted is relatively high, so that significant energy is required.

BRIEF DESCRIPTION OF THE DRAWINGS

Embodiments of the present disclosure are illustrated by way of example, and not by way of limitation, in the figures of the accompanying drawings.

DETAILED DESCRIPTION

Figure 1:
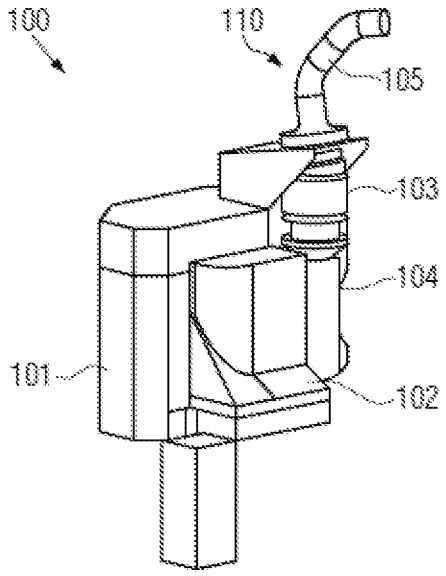
FIG. 1 illustrates a schematic external view of the hot glue unit, according to certain embodiments.

The present disclosure may provide a hot glue unit which enables the vapors produced when the hot glue is heated to be extracted reliably and with a reduced energy demand.

The hot glue unit according to the present disclosure for a labeling machine in the beverage processing industry includes at least a glue roller and a glue container as well as a housing in which the glue roller is arranged. The hot glue unit may include a filter unit with an extractor connected to the housing which can extract the gases from the interior of the housing and supply the gases to the filter unit before the gases can exit the hot glue unit.

The configuration of the housing with the filter unit and the extractor is to be understood such that the air from the interior of the housing is to first pass the filter unit, at least when the extractor is switched on, before it is to exit into the environment outside the housing.

The extractor is to suction (e.g., must only suction) the gases from the gas volume within the housing and the gases can further be filtered completely or as completely as possible in the filter unit before the gases can exit the hot glue unit into the environment. The energy demand for the extractor can therefore be significantly reduced, while the reliability of the extractor is increased.

In one embodiment, the filter unit further includes a filter cartridge and a collection tank, where the filter cartridge and the collection tank are connected to each other such that condensate forming in the filter cartridge can drain into the collection tank. When passing through the extractor and the entire filter unit (e.g., when passing through the filter cartridge), the gases that can develop when the hot glue is heated cool down, where they can be taken to a temperature that is lower than the condensation temperature. By connecting the filter cartridge to the collection tank, undesirable drainage of this condensate back into the extractor or even the housing can be prevented.

In a further embodiment, it is provided that the housing includes a fresh air opening which is arranged on a first side surface of the housing and where the extractor includes an extraction opening through which gases can be extracted from the interior of the housing, where the extraction opening is arranged at a second side surface of the housing. The resulting air flow from the fresh air opening to the extraction opening captures the gases (e.g., substantially all the gases) within the housing to the extent possible, so that efficient extraction can take place.

In one development of this embodiment, it is provided that the second side surface and the first side surface are opposite one another or at least separated from one another by two further side surfaces. The effect of the previous embodiment can then be further increased.

Furthermore, it can be provided that the filter cartridge and/or the collection tank are formed to be quickly exchangeable. Operation of the hot glue unit will inevitably lead to the contamination of the filter cartridge and the continuous filling of the collection tank, which makes an exchange necessary. Downtimes can be minimized by the quickly exchangeable configuration of these components. Quickly exchangeable means that the filter cartridge and/or the collection tank with the filter unit or more generally the hot glue unit are connected such that no tools are necessary for releasing the connections. They include, for example, click-in or plug connections. It can generally be provided that the entire filter unit can be quickly exchanged and released from the hot melt unit without tools. In some embodiments, any connections of the filter unit to the housing can be configured to be detachable without tools. It can additionally or alternatively be provided that at least the connection of a media channel leading through the filter unit to the housing or a media channel leading out from the housing is effected automatically. Self-centering elements can there be advantageously employed so that the media channels to be connected can be connected as simply and reliably as possible.

Furthermore, it can be provided that the filter cartridge includes a flow channel for the gas extracted from the interior of the housing which is longer than the maximum extension of the filter cartridge in at least one direction. For example, if the filter cartridge is cylindrical and has a height of 10 centimeters (cm), then the flow channel is longer than 10 cm. The longest possible flow channel ensures that parts of the gas mixture passing therethrough condense and are reliably collected in the collection tank and cannot escape into the environment.

In one development of this embodiment, it is provided that the flow channel is helically wound and/or that the filter unit includes a cooling system for cooling the flow channel Both variants ensure the condensation as completely as possible of gases forming in the housing.

In one embodiment, the extractor includes at least one fan arranged upstream or downstream of the filter cartridge. This fan can provide the necessary air flow to ensure that the gases developing in the housing are extracted.

In one development of this embodiment, two fans are provided, one upstream and one downstream of the filter cartridge. Any turbulence arising within the filter cartridge that might prevent the further flow of the gas can be compensated by the fan disposed downstream, whereas the fan upstream of the filter cartridge can effect reliable extraction of the gases from the housing.

In one embodiment, an outlet opening is arranged downstream of the filter cartridge through which air filtered by the filter cartridge can exit.

It can further be provided that the hot glue unit includes a glue scraper for scraping glue from the glue roller, where the glue scraper is arranged inside the housing.

The labeling machine according to the present disclosure for labeling containers (such as bottles in the beverage processing industry) may include a hot glue unit according to one of the above embodiments for applying hot glue onto the labels.

A method can include heating hot glue in a hot glue unit for a labeling machine and extracting gases developing in the hot glue unit by an extractor of a filter unit from a housing in which a glue roller and a glue container are arranged and supplied to the filter unit, before the gases exit the hot glue unit.

Furthermore, it can be intended that a filter cartridge and a collection tank of the filter unit are connected to each other such that the condensate forming in the filter cartridge drains into the collection tank.

It can further be provided that the air is extracted from the housing through an extraction opening in a second side surface and fresh air enters the housing through a fresh air opening in a first side surface.

Furthermore, it can be provided that a droplet separator being connected to the collection tank is arranged between the housing and the filter cartridge. Condensate droplets already formed can be separated from the gas mixture using the droplet separator before they reach the filter cartridge, whereby filter cartridge clogs can be prevented for a longer period of time, where the filter cartridge clogs require the labeling machine to be stopped.

Furthermore, it can be provided that the gases from the housing pass the filter cartridge along a flow channel which is, for example, helically wound or where a cooling system is provided which cools the flow channel, at least when gases are passing through.

According to the present disclosure, a method includes providing heated glue to a labelling machine by way of a hot glue unit, the method including heating the glue in a glue container and transporting the heated glue to a glue roller within a housing, where a filter unit is provided which extracts gases from the interior of the housing by way of an extractor and filters them before these gases exit the hot glue unit, where the hot glue unit is one according to the above embodiments.

Furthermore, it can be provided that a glue scraper scrapes the heated glue from the glue roller and transfers the heated glue onto a label which is subsequently applied to a container to be labeled, and/or transfers the heated glue onto a container to be labeled.

It can be provided in one development of this embodiment that the container to be labeled is not closed when it is labeled. With the extraction of the gases produced when the glue is heated, contamination (e.g., contamination of the interior of the container) can be prevented.

Furthermore, the filter unit can include a filter cartridge and a collection tank, where condensate forming in the filter cartridge drains into the collection tank through a connection of the filter cartridge to the collection tank.

In one embodiment, the gases are extracted from the interior of the housing through an extraction opening of the extractor which is disposed on a second side surface which differs from a first side surface in which a fresh air opening is arranged through which air flows into the housing. This ensures circulation of the gases within the housing to the extent possible, so that only small (e.g., no dead zones) form from where the gases cannot be extracted.

It can further be provided that the gas extracted from the interior of the housing passes through a flow channel within the filter cartridge that is optionally cooled. The flow channel (e.g., cooled flow channel) may cause condensation (to the extent possible) of evaporated components of the hot glue and the associated return to a possible collection tank of the filter unit.

Furthermore, it can be provided that the gases extracted from the interior of the housing first pass through a droplet separator in which condensate droplets condensed from the gases are deposited and supplied to the collection tank and subsequently pass the filter cartridge.

Furthermore, the method can include supplying containers from a blow molding machine to a labeling machine and providing the containers with a label that has been applied hot glue or applying hot glue onto the containers, where the hot glue is provided according to the method of the present disclosure, and subsequently supplying them to a filler and/or a closer.

Furthermore, a container treatment system is provided for treating containers such as bottles in the beverage processing industry, where the container treatment system in the direction of transport of the containers includes a blow molding machine, a labeling machine and a filler, where the labeling machine is the labeling machine of the preceding embodiment.

FIG. 1 shows a schematic view of a hot glue unit 100 according to one embodiment of the present disclosure. The hot glue unit is provided with a housing 101. Disposed therein is a glue roller, as is typical with hot glue units. Glue rollers are not illustrated in FIG. 1, but glue rollers are explained in more detail in FIG. 2. The glue roller can also be associated with a glue scraper in the housing for removing the glue from the glue roller.

The housing is substantially closed, except for a possible supply of fresh air. According to the present disclosure, a filter unit 110 is connected to the housing. This filter unit includes an extractor 102 with which the air can be directly extracted via a suitable extraction opening (presently not shown) from the housing. Extractor 102 is in direct communication with the interior of the housing (e.g., to extract air from the housing), for example, via the extraction opening already mentioned. In some embodiments, the housing and the extractor are configured such that no gases can exit the housing except through extractor 102. The housing together with the extractor can therefore be a substantially closed system.

The filter unit further includes a filter cartridge 103 and a collection tank 104. With respect to flow direction of the gases from the housing determined by the extractor, the filter cartridge is arranged downstream of the extractor in such a manner that the gases extracted by way of extractor 102 from the interior of the housing are supplied to filter cartridge 103.

In the filter cartridge, the gases can then, for example, pass through a flow channel and subsequently exit hot glue unit 100 via an outlet opening 105.

Likewise connected to the filter cartridge is a collection tank 104. The collection tank 104 is connected to the filter cartridge such that condensate is delivered into the collection tank from the flow channel of the filter cartridge or generally from a region in which gases condense in the filter cartridge. For example, small pores or other apertures can be provided at suitable locations in the filter cartridge through which fluid can pass into the collection tank 104.

The extraction power of the extractor and the performance of the filter cartridge and the capacity of collection tank 104 can be selected depending on the other system parameters (e.g., depending on the total amount of heated glue (for example, a certain amount of glue per hour)). For instance, the extractor can be configured to allow an air flow with a throughput of 10 liters/minute or 5 liters/minute, but also more or less. The filter cartridge may then enable a corresponding throughput and the collection tank can have a volume of, for example, up to 500 milliliters (mL). The larger the volume of the collection tank, the less frequently it is to be emptied. Also the filter cartridge is to be replaced only rarely when suitably sized. However, since this replacement work is inevitable during prolonged operation, it can be provided in one embodiment that the filter cartridge and/or the collection tank are connected to filter unit 110 in a quickly exchangeable manner, so that the filter cartridge and/or the collection tank can be removed from the filter unit at the expense of little time and little mechanical effort and be replaced with new filter cartridges and/or collection tanks, respectively.

In some embodiments, the state of the filter unit can be monitored. Suitable sensors, such as pressure sensors, can be connected to the filter unit and measure the differential pressure upstream and downstream of the filter unit. The measurement results can be displayed, for example, on a control unit (e.g., a display of the control unit) or otherwise processed by use of a computer or a similar device for processing data. Other methods for measuring certain properties, such as inductive, optical or capacitive methods are possible there. The measurement values obtained are used to determine whether the filter or the filter cartridge is already clogged or blocked by condensate of the glue. Should this be detected, then the operator can be instructed to exchange or clean the filter cartridge.

In some embodiments, a future state of the filter or the filter cartridge is predicted. The future state may be predicted based on the measurement values and/or a suitable flow and condensation model for the filter cartridge for a point in time in the future. In some embodiments, an automated order for a new filter cartridge is placed by the labelling machine or a control unit associated therewith (e.g., based on the predicted future state), such as a computer, via the Internet or other data connection. Maintenance intervals can also be determined based on the predicted future state and be communicated to an operator.

It can also alternatively or additionally be provided that at least the collection tank has a discharge opening via which condensate can be drained off at specific time intervals. For example, when reaching a filling level of 80%, the operator can be advised via a control unit (such as a computer) that the collection tank needs to be emptied or exchanged. For example, a level sensor can be provided in the collection tank. It can be configured in mechanical terms to be in the form of a float.

Figure 2:
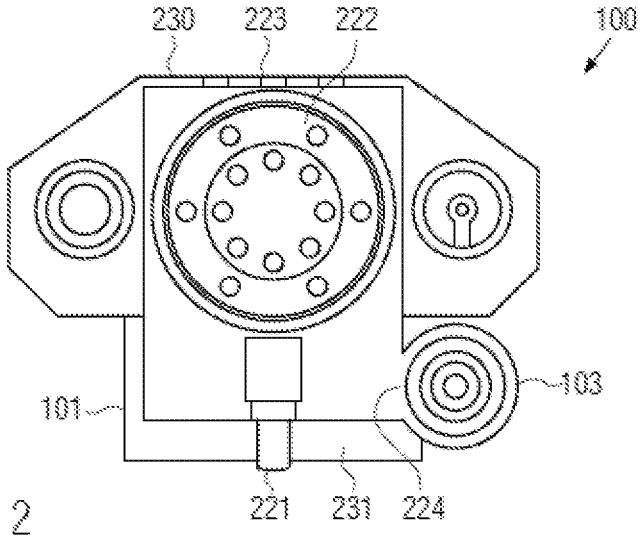
FIG. 2 illustrates a sectional view through the hot glue unit of FIG. 1, according to certain embodiments.

FIG. 2 shows a sectional view through the hot glue unit of FIG. 1. As shown there, the hot glue unit within housing 101 includes a glue roller 222 from which glue can exit and be deposited by use of glue scraper 221. The glue roller can be rotated to deposit the glue by use of glue scraper 221.

Furthermore, fresh air opening 223 in housing 101 is shown in FIG. 2. The fresh air opening 223 is located on a side 230 of housing 101, for example, on one side of glue roller 222. Extraction opening 224, with the aid of which the extractor can extract gases from the housing, is shown in FIG. 2 on side surface 231. As can be seen, fresh air openings 223 and outlet openings 224 are provided on different side surfaces of the housing. The resulting flow path of the gases therefore captures substantially all regions within the housing. An arrangement of extraction opening 224 can be advantageous on the side of the housing facing away from the glue roller to the side surface in which fresh air opening 223 is provided. It is also possible to provide several extraction openings in order to avoid "dead zones" from where gases can be extracted with little effectiveness.

In the region of extraction opening 224 but also downstream of extraction opening 224, but at least upstream of the filter cartridge, the extractor can include a fan whose direction of rotation is oriented such that it extracts gases from housing 101 through the extraction opening and supplies the gases to filter cartridge 103. The extraction opening or a channel directly adjoining it can be connected to a flow channel of the filter cartridge so that the gases passing through the extraction opening reach the filter cartridge.

Figure 3:
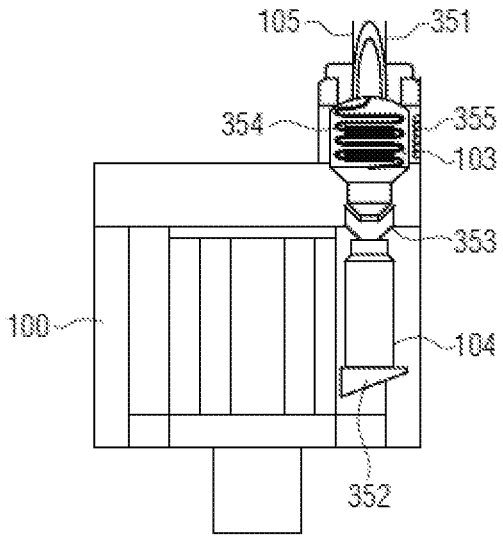
FIG. 3 illustrates a sectional view in a plane perpendicular to the sectional plane of FIG. 2 through the hot glue unit according to FIG. 1, according to certain embodiments.

FIG. 3 schematically shows a sectional view through the hot glue unit. This sectional view is perpendicular to the sectional plane shown in FIG. 2 and passes through the collection tank and filter cartridge 103, respectively. Connection 353 of the extractor to filter cartridge 103 is there recognizable at the lower part or at least at the part disposed opposite to the outlet opening at the upper end of the filter cartridge. Arranged below filter cartridge 103 is collection tank 104. The collection tank 104 can be mounted, for example, on support 352 shown.

As already described above, the filling level of the collection tank may be determined and based thereon, for example, alert the operator with the aid of a control unit to empty or exchange collection tank 104. Support 352 can be configured as a weighing counter or include such so that the filling level of the collection tank can be determined on the basis of a comparison of the empty weight of the collection tank to a measured weight of the collection tank. If this difference reaches a predetermined value, for example 200 grams (g), the operator can be requested to exchange the collection tank.

The filter cartridge presently shown can include a helical flow channel in the interior, which is to be passed by the gas extracted from the interior of housing 101 before it reaches outlet opening 105. When passing flow channel 354, the gas cools down and can condense so that condensates can effectively remain in the filter cartridge and be delivered into collection tank 104.

Furthermore, a cooling system 355 is shown schematically in the region of the filter cartridge. This cooling system can not only be configured as part of filter unit 110 but can also entirely or in part be integrated into filter cartridge 103.

In one embodiment, the cooling system is configured to cool at least flow channel 354, which promotes the formation of condensate. This condensate typically includes (e.g., consists of) the outgassing of the hot glue, which inevitably develops when the hot glue is heated. By selectively cooling the gas mixture (including (e.g., consisting of) air and the gases of the hot glue) passing flow channel 354, condensation of the gases of the hot glue to the degree possible and concomitant separation of the remaining air may occur (e.g., can be ensured), so that effective separation of the condensate into the collection tank occurs (e.g., can be ensured).

The collection tank can additionally be equipped with a heating element (for example an infrared radiator or a heating coil) or the collection tank can be associated with a heating element. The condensate disposed in the collection tank can be kept in the liquid state with this heating element, which allows for discharge of the condensate and therefore reuse of the collection tank. To save energy, the cooling system and the optionally provided heating element can be connected to each other by way of a common heat exchanger system (e.g., so that the waste heat of the cooling system can be used to operate the heating element, so that the waste heat of the heating element can be used to operate the cooling system). Furthermore, both the cooling system and the heating element can be controlled by a suitable control unit, for example the central control unit of a labeling machine in which the hot glue unit is disposed, so that the respective power (i.e. cooling power and heating power) of the cooling system and the heating element is controlled in dependence of the other system parameters. For example, if the gas throughput through the filter cartridge is comparatively low, then only a low cooling capacity can be provided. If the gas throughput increases, then the cooling capacity can be increased accordingly. Likewise, the heating element can be controlled such that its heating power is increased depending on the filling level of the collection tank. By controlling the heating element, the condensate in the collection container may remain as liquid even at high filling levels and the condensate may not inadvertently start to boil (e.g., or considerable vapor development may not inadvertently start to arise) at low filling levels.

A further fan 351 is also indicated in FIG. 3 downstream of the filter cartridge but upstream of outlet opening 105. The fan 351 can extract the air or the gas mixture, respectively, from the filter cartridge and discharge it through outlet opening 105, so that unintentional turbulence within the filter cartridge does not adversely affect the gas flow.

In order to improve the cooling of the gases described in FIG. 3 and the concomitant condensation, a cooling system, presently not shown, can be provided which additionally cools housing 101 and flow channel 354 from outlet opening 105 to filter cartridge 103. If a droplet separator is arranged upstream of the filter cartridge, separation of developing condensate may occur in the droplet separator by way of this additional cooling (e.g., via the cooling system), whereby clogging of the filter cartridge can be prevented.

Cooling of housing 101 and/or of flow channel 354 may be provided by a double-walled configuration. In the double-walled configuration, cold air can be passed in a gap in the double-walled housing (e.g., for example using an external air supply and/or using (external) air conditioning) and cool the housing wall and (indirectly) also the interior of the housing, thereby also cooling the gases developing when the glue is heated. The cold air can be obtained, for example, from the exhaust air of a blow molding machine, which is interconnected (blocked) with the labeling machine to form a container treatment system. In some embodiments, liquid cooling may be used, for example, using cooling water for control cabinets or the like. In some embodiments, adiabatic cooling may be used.

Various materials can be used as filter media for the filter cartridge. For instance, cardboard filters, paper filters or filter wadding, but also glass fiber matting, ceramic filters, sintered metal, steel wool, chemical filter materials in general, depth filters, electric filters, water filters or droplet separators can be used.

For neutralization of unpleasant odors in the area of the labeling machine, carbon filters can further be employed. The filter (e.g., the filter cartridge) can also be connected to a cleaning system (for example backwash) to prevent clogging of the filter cartridge as long as possible. The backwash can flush the filter medium or the entire filter cartridge with a suitable flushing medium (e.g., a medium in which substantially all residues of the glue dissolve), for example, at certain time intervals or depending on the condition of the filter (more information on determining this was given above), whereby residue can be removed. Water or specialized solvents may be used. The flushing medium with the possibly dissolved glue residue can be supplied to collection tank 104. This is advantageous for the reason that the remaining glue residue in the collection tank can then be prevented from curing.

Figure 4:
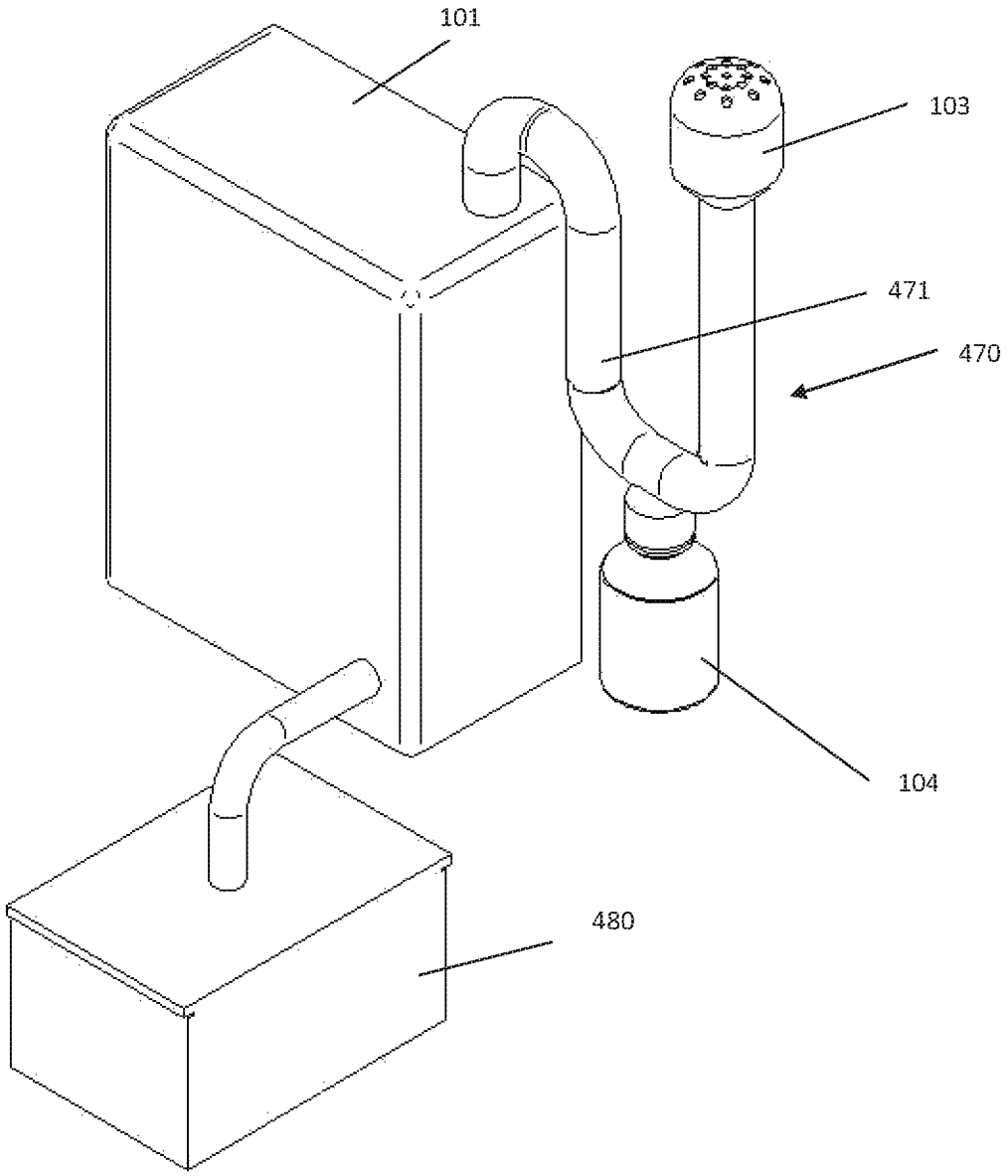
FIG. 4 illustrates a further embodiment of the hot glue unit, according to certain embodiments.

It can further be provided according to the present disclosure that the filter cartridge and the collection tank are not directly connected to each other and the filter cartridge does not directly adjoin the housing. FIG. 4 shows a possible embodiment in this regard.

In this embodiment, a tube 470 leads out of housing 101. Tube 470 has a U-shape, where collection tank 104 is connected to the lowest point of the U-shape. This favors draining of the condensate. The tube can be made, for example, of plastic material or metal and can be produced using a three-dimensional (3D) printing process.

Furthermore, it can be provided that the inner surface of the tube includes baffles, baffle screens or ribs, so that condensation of the gases is enhanced by an increased surface. Furthermore, the inner surface of the tube can be provided with a lipophobic coating. This can promote drainage of the condensate at the surface of the tube. This includes not only suitable coatings, but also polishing or sealing and other surface finishes can cause this effect.

The tube can have ribs on the outer surface and/or be embodied with double walls. This can better enhance cooling of the interior and thereby condensation of the gases.

The tube can also have a further bypass, presently not shown, which is connected to glue container 480 and opens into the tube at least in a region which is arranged upstream of collection tank 104. When the glue in glue container 480 is heated, the developing gases can then be directly extracted and supplied to the collection tank.

Furthermore, a droplet separator, presently not shown, can be provided (according to one or more embodiments described above) upstream of the filter cartridge. The droplet separator can be arranged, for example, in the "descending" branch 471 of U-shaped tube 470 and include a connection to collection tank 104 so that condensate collected in the droplet separator can be delivered to the collection tank.

The additional devices optionally provided downstream of filter cartridge 104, such as fans, can be provided analogously to the above embodiments.

The tube and substantially all further components of the embodiment described in FIG. 4 can also include substantially all the measures for cooling, as already described. In some embodiments, the tube can be configured having a double wall and a cooling medium can circulate within this double wall in order to promote condensation of the gases.

While presently not shown, it can nevertheless be provided that housing 101 is not completely "opaque". The housing may have a robust configuration, for example the housing may be made of steel. However, to monitor the processes within the housing (e.g., the interaction between the glue roller and the glue scraper and transfer of the glue to the labels by way of the glue scraper), the housing may be at least in part transparent (e.g., includes an inspection window). The inspection window can be configured to open, but opening the inspection window may not be possible during operation in order to prevent the escape of potentially hazardous gases. Therefore, the inspection window can be connected to a suitable detector, for example, in the form of a magnetic switch or ultrasonic sensor, which registers the opening action or the attempt to open the inspection window and causes the labeling machine and the hot glue unit to shut down.

Overall, the hot glue unit according to the present disclosure together with its filter unit is configured such that the air discharged from the filter unit into the environment at the end (i.e. after cleaning in the filter cartridge) has breathing air quality (e.g., even clean room quality).

The embodiments presently described may be used both for separately embodied labeling machines as well as for interconnected labeling machines. The interconnected labeling machines are operated in the framework of container treatment systems together with an upstream blow molding machine (arranged upstream in the transport direction of the containers) or another device for producing containers and a downstream filler and/or capper (arranged downstream in the transport direction of the containers).

It is to be understood that the above description is intended to be illustrative, and not restrictive. Many other embodiments will be apparent upon reading and understanding the above description. Although embodiments of the present disclosure have been described with reference to specific example embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense. The scope of the invention should, therefore, be determined with reference to the appended claims, along with the full scope of equivalents to which such claims are entitled.

What is claimed is:

1. A hot glue unit for a labeling machine in a beverage processing industry, the hot glue unit comprising:

a housing;

a glue roller disposed in an interior of the housing;

a glue container; and a filter unit comprising an extractor connected to the housing to extract gases from the interior of the housing and supply the gases to the filter unit before the gases exit the hot glue unit, wherein the filter unit further comprises a filter cartridge and a collection tank, wherein the filter cartridge and the collection tank are connected to each other, wherein condensate developing in the filter cartridge is to drain into the collection tank, wherein, with respect to a flow direction of the gases extracted via the extractor from the housing, the filter cartridge and the collection tank are arranged downstream of the extractor, and wherein the gases extracted via the extractor from the interior of the housing are supplied to the filter cartridge.

2. The hot glue unit of claim 1, wherein the housing comprises a fresh air opening arranged on a first side surface of the housing, wherein the extractor comprises an extraction opening through which the gases are to be extracted from the interior of the housing, and wherein the extraction opening is arranged at a second side surface of the housing.

3. The hot glue unit of claim 2, wherein the second side surface and the first side surface are opposite to each other or at least separated from each other by two further side surfaces.

4. The hot glue unit according to claim 1, wherein at least one of the filter cartridge or the collection tank is configured to be exchangeable.

5. The hot glue unit of claim 1, wherein the filter cartridge comprises a flow channel for the gases extracted from the interior of the housing, wherein the flow channel is longer than the filter cartridge in at least one direction.

6. The hot glue unit of claim 5, wherein at least one of:

the flow channel is helically wound; or the filter unit comprises a cooling system for cooling the flow channel.

7. The hot glue unit of claim 1, wherein the extractor comprises at least one fan disposed upstream or downstream from the filter cartridge.

8. The hot glue unit of claim 7, wherein the at least one fan comprises a first fan disposed upstream from the filter cartridge and a second fan disposed downstream from the filter cartridge.

9. The hot glue unit of claim 1, wherein an outlet opening is arranged downstream from the filter cartridge, wherein filtered air is to exit the filter cartridge via the outlet opening.

10. The hot glue unit of claim 1 further comprising a glue scraper for scraping glue from the glue roller and transferring the glue onto labels, wherein the glue scraper is disposed in the housing.

11. A labeling machine for labeling containers with labels in a beverage processing industry, wherein the labeling machine comprises a hot glue unit for applying hot glue onto the labels, the hot glue unit comprising:

a housing;

a glue roller disposed in an interior of the housing;

a glue container; and a filter unit comprising an extractor connected to the housing to extract gases from the interior of the housing and supply the gases to the filter unit before the gases exit the hot glue unit, wherein the filter unit further comprises a filter cartridge and a collection tank, wherein the filter cartridge and the collection tank are connected to each other, wherein condensate developing in the filter cartridge is to drain into the collection tank, wherein, with respect to a flow direction of the gases extracted via the extractor from the housing, the filter cartridge and the collection tank are arranged downstream of the extractor, and wherein the gases extracted via the extractor from the interior of the housing are supplied to the filter cartridge.

12. The labeling machine of claim 11, wherein the extractor comprises a first fan disposed upstream from the filter cartridge and a second fan disposed downstream from the filter cartridge.

13. The labeling machine of claim 12, wherein an outlet opening is arranged downstream from the filter cartridge, wherein filtered air is to exit the filter cartridge via the outlet opening.

14. A container treatment system for treating containers in a beverage processing industry, the container treatment system comprising:

a blow molding machine;

a labeling machine for labeling the containers with labels, wherein the labeling machine comprises a hot glue unit for applying hot glue onto the labels, the hot glue unit comprising:

a housing;

a glue roller disposed in an interior of the housing;

a glue container; and a filter unit comprising an extractor connected to the housing to extract gases from the interior of the housing and supply the gases to the filter unit before the gases exit the hot glue unit, wherein the filter unit further comprises a filter cartridge and a collection tank, wherein the filter cartridge and the collection tank are connected to each other, wherein condensate developing in the filter cartridge is to drain into the collection tank, wherein, with respect to a flow direction of the gases extracted via the extractor from the housing, the filter cartridge and the collection tank are arranged downstream of the extractor, and wherein the gases extracted via the extractor from the interior of the housing are supplied to the filter cartridge; and a filler.

15. The container treatment system of claim 14, wherein a direction of transport of the containers is from the blow molding machine to the labeling machine, and from the labeling machine to the filler.

16. The container treatment system of claim 14, wherein the housing comprises a fresh air opening arranged on a first side surface of the housing, wherein the extractor comprises an extraction opening through which the gases are to be extracted from the interior of the housing, wherein the extraction opening is arranged at a second side surface of the housing, wherein the second side surface and the first side surface are opposite to each other or at least separated from each other by two further side surfaces.

17. The container treatment system of claim 14, wherein the filter cartridge comprises a flow channel for the gases extracted from the interior of the housing, wherein the flow channel is longer than the filter cartridge in at least one direction, wherein at least one of:

the flow channel is helically wound; or the filter unit comprises a cooling system for cooling the flow channel.

* * * * *